US011073288B2

(12) United States Patent
Diehl et al.

(10) Patent No.: US 11,073,288 B2
(45) **Date of Patent: *Jul. 27, 2021**

(54) THICK OVEN DOOR WITH COOLING

(71) Applicants: BSH Home Appliances Corporation, Irvine, CA (US); BSH Hausgeräte GmbH, Munich (DE)

(72) Inventors: Ronald Allen Diehl, LaFollette, TN (US); Josiah Fronckowiak, LaFollette, TN (US); Ian McIver, Knoxville, TN (US); Rose Marie Parker, Caryville, TN (US); Timothy Russell, Jacksboro, TN (US)

(73) Assignees: BSH Home Appliances Corporation, Irvine, CA (US); BSH Hausgeräte GmbH, Munich (DE)

( * ) Notice: Subject to any disclaimer, the term of this patent is extended or adjusted under 35 U.S.C. 154(b) by 245 days.

This patent is subject to a terminal disclaimer.

(21) Appl. No.: 16/452,577

(22) Filed: Jun. 26, 2019

(65) Prior Publication Data

US 2020/0408418 A1 Dec. 31, 2020

(51) Int. Cl.
*F24C 15/00* (2006.01)
*F24C 15/04* (2006.01)

(52) U.S. Cl.
CPC ..... *F24C 15/006* (2013.01); *F24C 15/04* (2013.01)

(58) Field of Classification Search
CPC ..... F24C 15/006; F24C 15/02; F24C 15/04
See application file for complete search history.

(56) References Cited

U.S. PATENT DOCUMENTS

| | | | | |
|---|---|---|---|---|
| 3,889,099 | A | 6/1975 | Nuss | |
| 4,163,444 | A | 8/1979 | Drouin | |
| 5,107,821 | A | 4/1992 | van Blanquet et al. | |
| 5,441,036 | A | 8/1995 | Mikalauskas, II et al. | |
| 6,561,180 | B1 * | 5/2003 | Austin | F24C 15/02 126/190 |
| 6,904,904 | B2 | 6/2005 | Walther et al. | |
| 7,228,857 | B2 | 6/2007 | Kim et al. | |
| 7,726,295 | B2 | 6/2010 | Elkasevic | |

(Continued)

FOREIGN PATENT DOCUMENTS

| | | | |
|---|---|---|---|
| FR | 2818360 | A1 | 12/2000 |
| WO | 2005073635 | A1 | 8/2005 |

*Primary Examiner* — David J Laux
*Assistant Examiner* — Nikhil P Mashruwala
(74) *Attorney, Agent, or Firm* — Michael E. Tschupp; Andre Pallapies; Brandon G. Braun

(57) ABSTRACT

A door assembly for a domestic cooking appliance having a cooking compartment for heating a food item includes an outer door skin; an inner door liner; a transparent viewing panel assembly between the outer door skin and the inner door liner, the viewing panel assembly being configured to permit a user to view the cooking compartment when the door assembly is in a closed position; an interior region located between the outer door skin and the viewing panel assembly; a lower air opening in a lower region of the door assembly that fluidly connects the interior region with an environment outside of the door assembly; and a top upper air opening in an uppermost surface of the outer door skin that fluidly connects the interior region with the environment outside of the door assembly.

18 Claims, 18 Drawing Sheets

(56) References Cited

U.S. PATENT DOCUMENTS

| | | | | |
|---|---|---|---|---|
| 7,847,219 | B2 * | 12/2010 | Kim | F24C 15/04 219/391 |
| 7,874,289 | B2 * | 1/2011 | Larsen | F24C 15/006 126/198 |
| 8,857,422 | B2 * | 10/2014 | Elkasevic | F24C 15/006 126/200 |
| 9,022,017 | B2 * | 5/2015 | Hyun | F24C 15/006 126/21 A |
| 9,115,903 | B2 | 8/2015 | Lim et al. | |
| 9,677,770 | B2 * | 6/2017 | Lee | F24C 15/04 |
| 9,746,187 | B2 * | 8/2017 | Kim | F24C 15/006 |
| 10,782,028 | B2 * | 9/2020 | Ladner | F24C 15/04 |
| 2010/0065035 | A1 * | 3/2010 | Armstrong | F24C 15/006 126/198 |
| 2017/0261213 | A1 * | 9/2017 | Park | F24C 7/085 |
| 2018/0224130 | A1 | 8/2018 | Lee | |

* cited by examiner

THICK OVEN DOOR WITH COOLING

FIELD OF THE INVENTION

The invention is directed to a domestic cooking appliance. More particularly, embodiments of the invention are directed to a thick oven door that provides cooling of the oven door.

An example of an application for the invention is a domestic kitchen oven having a thick door that has cooling integrated into the door.

BACKGROUND OF THE INVENTION

Some modern domestic kitchens include cooking appliances such as ovens and ranges that have one or more heating elements that provide the heat for cooking a food item in a cooking compartment of the appliance. The heat produced by the heating elements can be transmitted through a door of the cooking compartment. It is desirable to limit the temperature of the outside of the door. Limiting the temperature of the outside of the door is complicated by the existence of a glass, or other transparent, panel in the door.

Applicants recognized an improvement to the above arrangement and implement that improvement in embodiments of the invention.

SUMMARY

The invention achieves the benefit of providing a domestic cooking appliance door that is relatively thick when compared to other domestic cooking appliance doors, while also providing adequate airflow through the door to sufficiently cool the door.

Particular embodiments of the invention are directed to a domestic cooking appliance for heating a food item. The appliance includes a main housing; a cooking compartment in the main housing, the cooking compartment being configured to receive the food item to be heated; and a door assembly attached to the main housing and movable between a closed position in which the door assembly closes the cooking compartment and an open position in which the door assembly allows access to the cooking compartment. The door assembly includes an outer door skin; an inner door liner; a transparent viewing panel assembly between the outer door skin and the inner door liner, the viewing panel assembly permitting a user to view the cooking compartment when the door assembly is in the closed position; an interior region located between the outer door skin and the viewing panel assembly; a lower air opening in a lower region of the door assembly that fluidly connects the interior region with an environment outside of the door assembly; and; a top upper air opening in an uppermost surface of the outer door skin that fluidly connects the interior region with the environment outside of the door assembly.

Some embodiments further comprise an air guide located in the interior region, the air guide having an angled portion. The interior region has a first horizontal cross-sectional area taken at a location vertically between the angled portion of the air guide and the viewing panel assembly, the interior region has a second horizontal cross-sectional area at a location vertically between the angled portion of the air guide and the top upper air opening, and the second cross-sectional area is smaller than the first cross-sectional area.

Some embodiments further comprise a sealing surface of the main housing, the sealing surface at least substantially surrounding an opening in the main housing that provides access to the cooking compartment; and a sealing surface of the inner door liner that contacts the sealing surface of the main housing and provides a thermal seal between the main housing and the inner door liner. The upper panel of the outer door skin extends horizontally to a vertical plane that is coplanar with the sealing surface of the inner door liner.

Other embodiments of the invention are directed to a door assembly for a domestic cooking appliance having a cooking compartment for heating a food item. The door assembly includes an outer door skin; an inner door liner; a transparent viewing panel assembly between the outer door skin and the inner door liner, the viewing panel assembly being configured to permit a user to view the cooking compartment when the door assembly is in a closed position; an interior region located between the outer door skin and the viewing panel assembly; a lower air opening in a lower region of the door assembly that fluidly connects the interior region with an environment outside of the door assembly; and a top upper air opening in an uppermost surface of the outer door skin that fluidly connects the interior region with the environment outside of the door assembly.

BRIEF DESCRIPTION OF THE DRAWINGS

The following figures form part of the present specification and are included to further demonstrate certain aspects of the disclosed features and functions, and should not be used to limit or define the disclosed features and functions. Consequently, a more complete understanding of the exemplary embodiments and further features and advantages thereof may be acquired by referring to the following description taken in conjunction with the accompanying drawings, wherein.

DETAILED DESCRIPTION

The invention is described herein with reference to the accompanying drawings in which exemplary embodiments of the invention are shown. The invention may, however, be embodied in many different forms and should not be construed as limited to the embodiments set forth herein.

As explained above, embodiments of the invention provide an improvement to a door of a domestic oven or other cooking appliance. In some applications, it is desirable to provide a thick, heavy looking door on a domestic cooking appliance such as an oven. Problems can arise with cooling a thick door in that it can be difficult to produce the required cooling air flow through the door. Embodiments of the invention address this problem by providing air openings in the top and bottom surfaces of the door, in addition to a glass retainer and an air guide that channel the air flow and provide a change in cross-sectional area in an interior region of the door.

Figure 1:
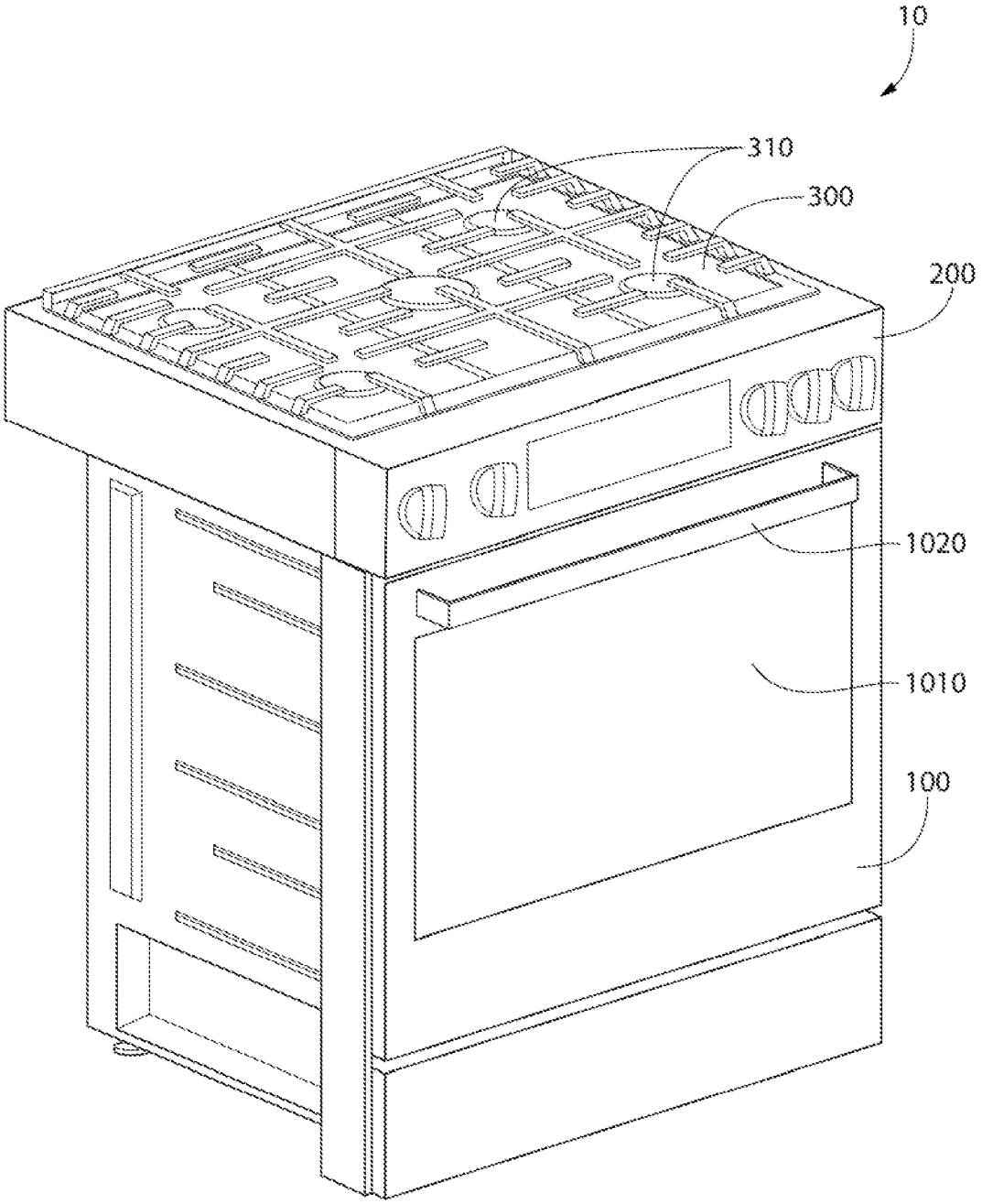
FIG. 1 is a perspective schematic view of an appliance in accordance with exemplary embodiments of the invention.

FIG. 1 shows an example of an appliance 10 in accordance with embodiments of the invention. Appliance 10 has a plurality of burners 310 on a cooktop 300, and a control panel 200 that contains one or more controls for controlling functions of appliance 10. Appliance 10 also has a door (for example, door 100) that provides access to a cooking compartment inside appliance 10. Appliance 10 shown in FIG. 1 has a panel (such as, for example, a drawer) located under oven door 100. Embodiments of the invention include oven doors 100 that are directly above panels (such as shown in FIG. 1), and oven doors that are directly above a floor or other surface, such that cooling air can enter door 100 from below. Door 100 is just one example of doors in accordance with embodiments of the invention.

Figure 2:
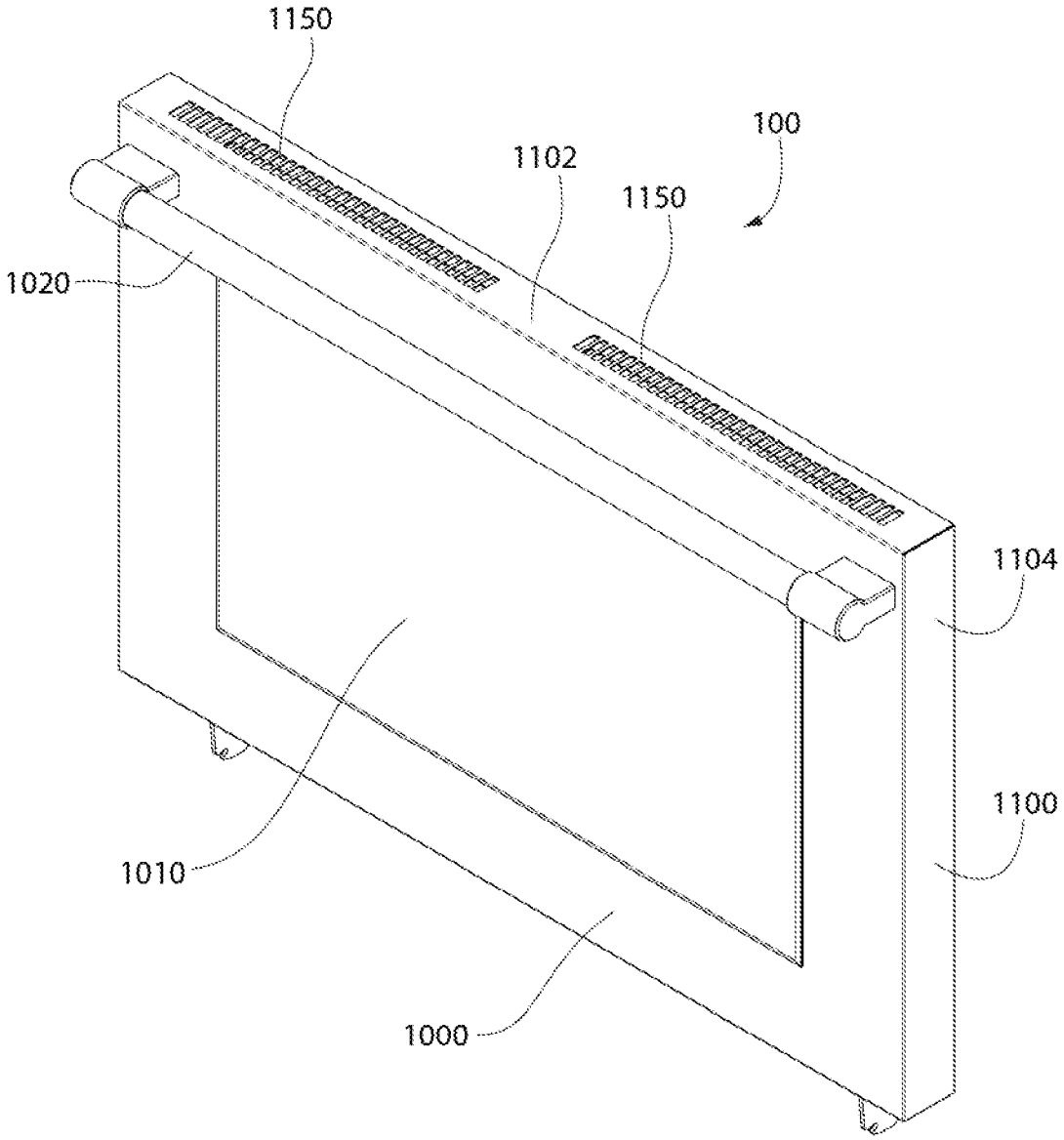
FIG. 2 is an upper front perspective view of an appliance door in accordance with embodiments of the invention.
Figure 3:
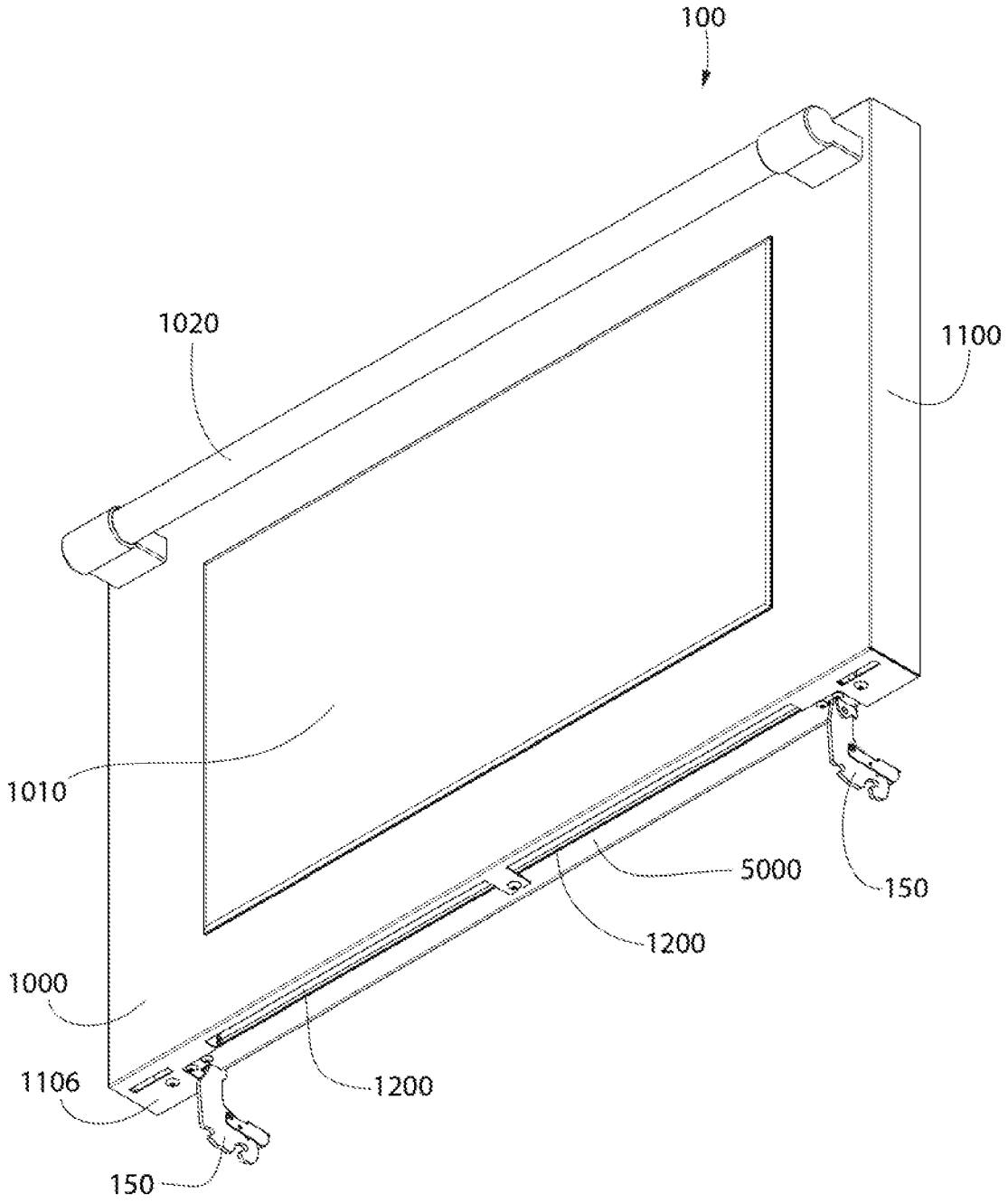
FIG. 3 is a lower front perspective view of the appliance door shown in FIG. 2.

FIGS. 2 and 3 show oven door 100 in accordance with exemplary embodiments of the invention. The following drawings and description will show features of the exemplary embodiment that provide improved cooling of oven door 100 so that the temperature of the outside of the door is maintained at an acceptable level.

In this example, oven door 100 has an outer skin 1000 that includes the outermost surfaces on the front, top, bottom, and sides of door 100. The rear outermost surface of door 100 is an inner liner 5000 (shown in more detail below). In this example, outer skin 1000 has a main portion 1100, a viewing pane 1010, a handle 1020, and top upper air openings 1150. Handle 1020 is gripped by a user of the oven to move oven door 100 from a closed position in which the cooking compartment is closed, and an open position in which the cooking compartment is accessible to the user.

FIG. 3 shows lower portions of two door hinge assemblies 150. Door hinge assemblies 150 attach door 100 to a main housing of an appliance such as, for example, appliance 10. Door hinge assemblies can be any appropriate type of hinge assembly such as, for example, a damped soft-close hinge.

FIG. 3 shows two lower air openings 1200 that, in this example, are formed by gaps between outer skin 1000 and inner liner 5000. Other embodiments, have lower air openings that are slots or other type openings in one or both of outer skin 1000 and inner liner 5000. In various embodiments, lower air openings are different sizes, shapes, and number than the example shown in FIG. 3. Main portion 1100 has, in this embodiment, an upper section 1102, side sections 1104, 1108, and a bottom section 1106.

Figure 4:
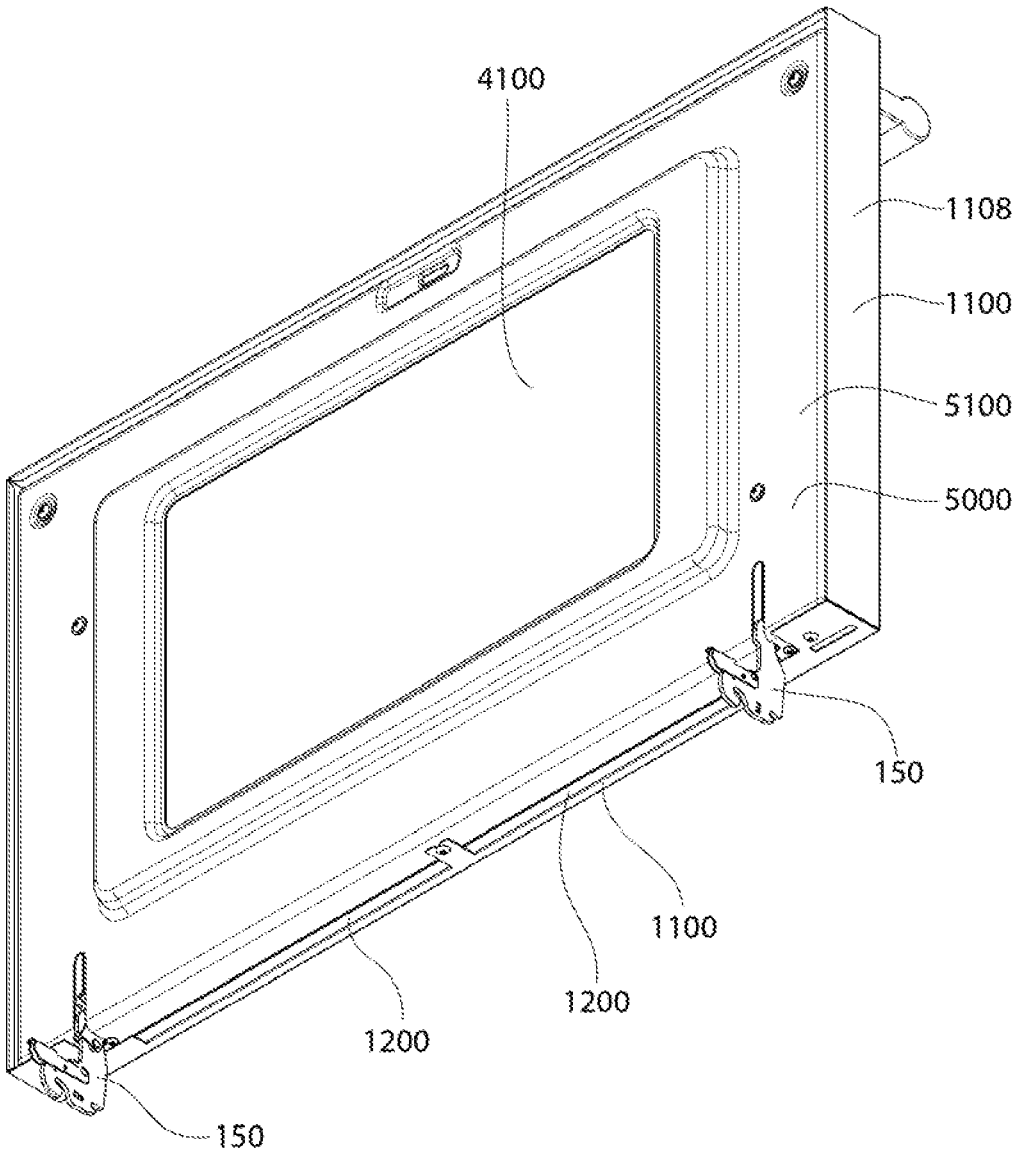
FIG. 4 is a lower rear perspective view of the appliance door shown in FIG. 2.
Figure 5:
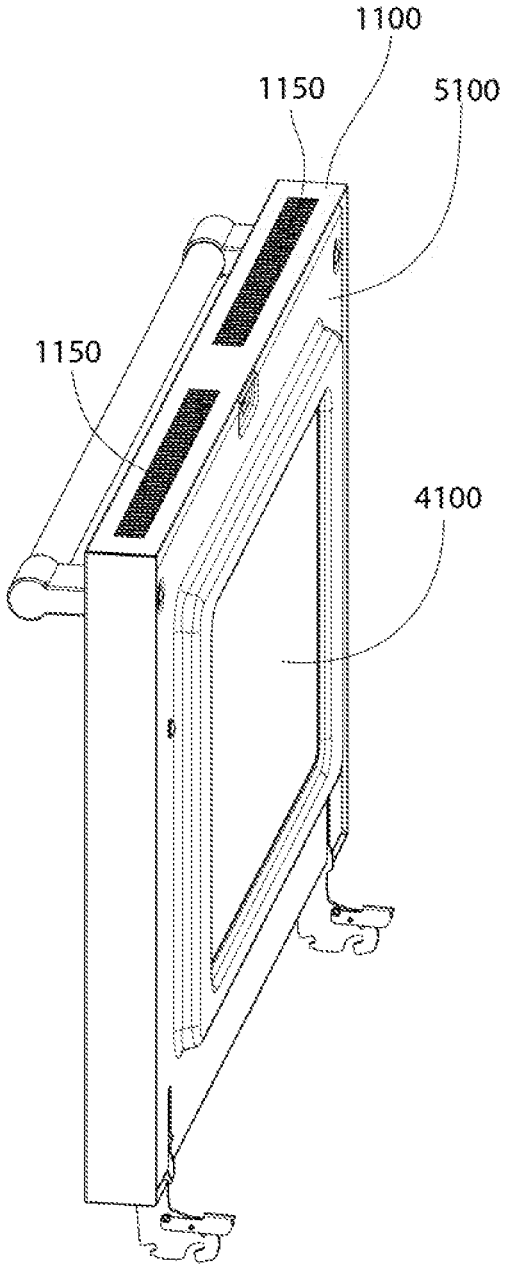
FIG. 5 is an upper side perspective view of the appliance door shown in FIG. 2.
Figure 6:
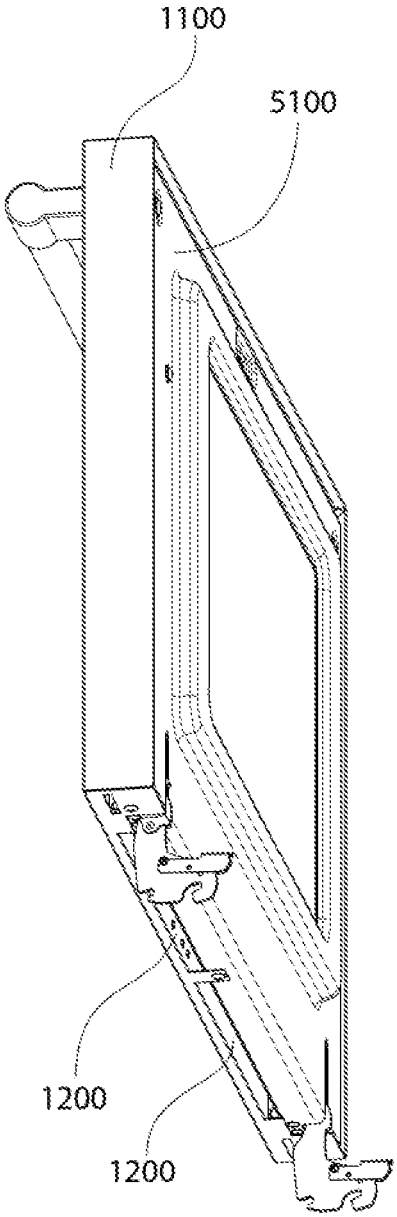
FIG. 6 is lower side perspective view of the appliance door shown in FIG. 2.

FIGS. 4-6 show inner liner 5000 having a main portion 5100 that, in this example, fits inside of main portion 1100 of outer skin 1000. Also show in FIG. 4 is a viewing pane 4100 of a glass pack 4000 (see FIG. 11) that is positioned between outer skin 1000 and inner liner 5000.

Figure 7:
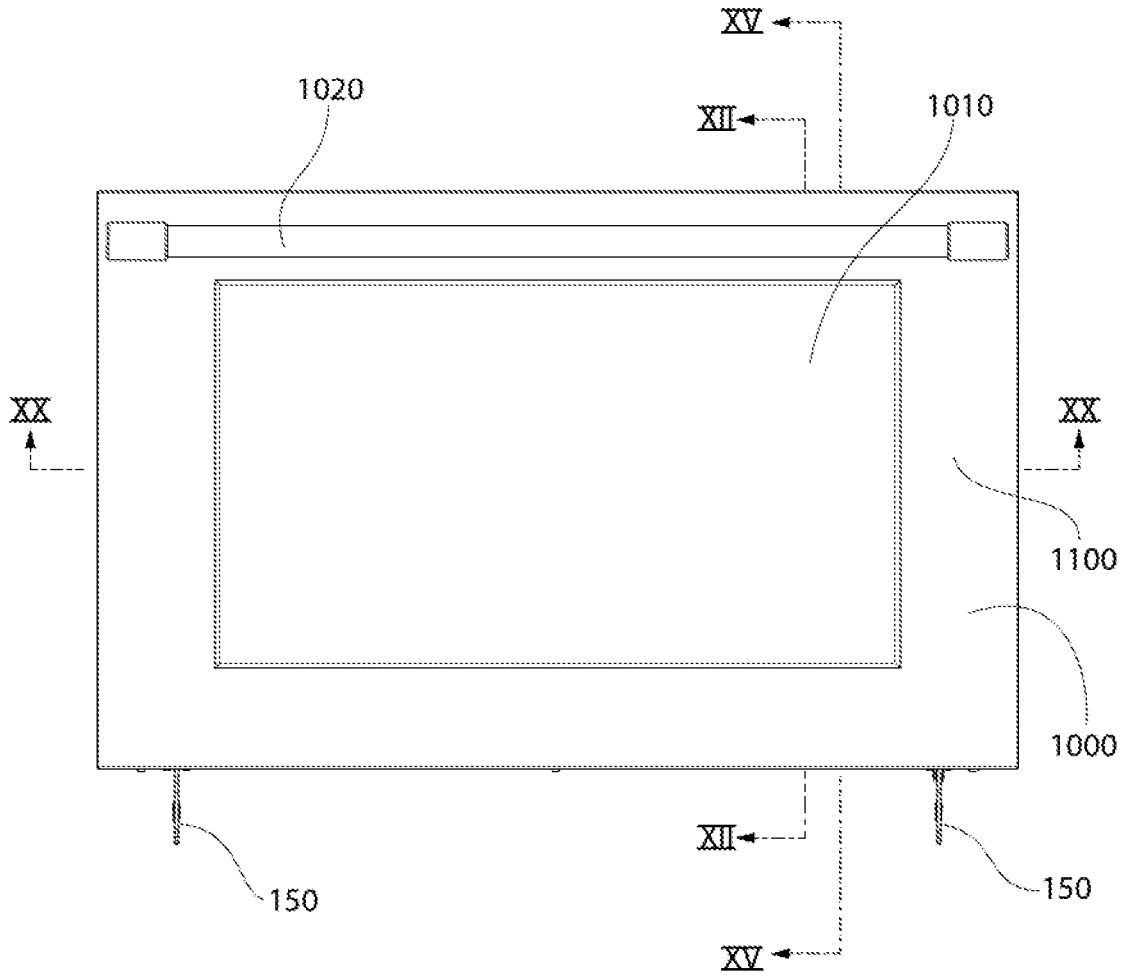
FIG. 7 is a front view of the appliance door shown in FIG. 2.
Figure 12:
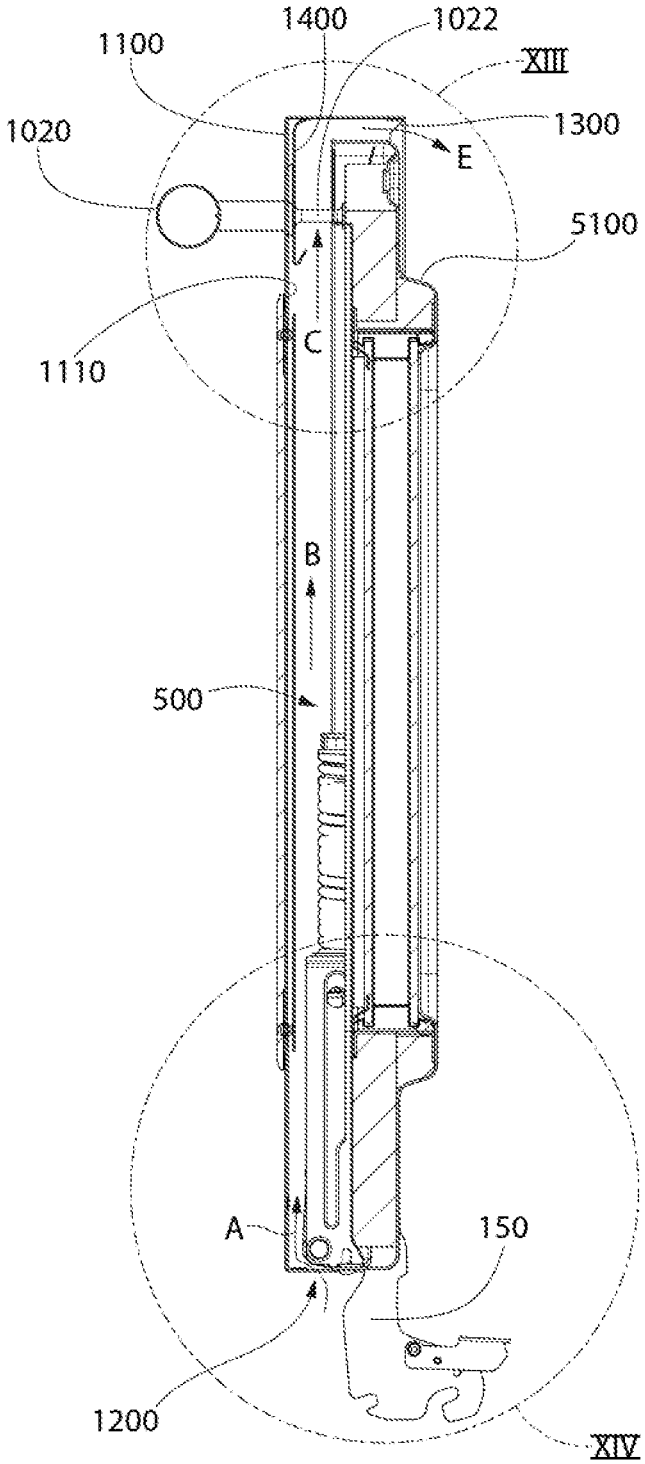
FIG. 12 is a sectional view of the appliance door shown in FIG. 2 taken along section line XII-XII of FIG. 7.
Figure 15:
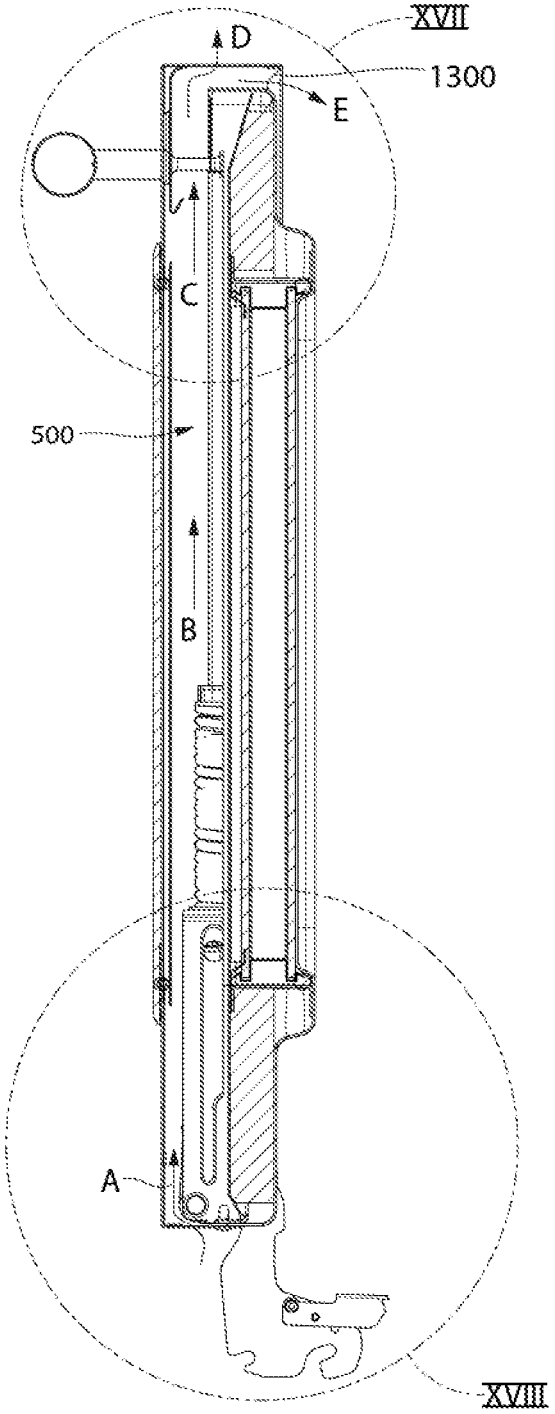
FIG. 15 is a sectional view of the appliance door shown in FIG. 2 taken along section line XV-XV of FIG. 7.
Figure 20:
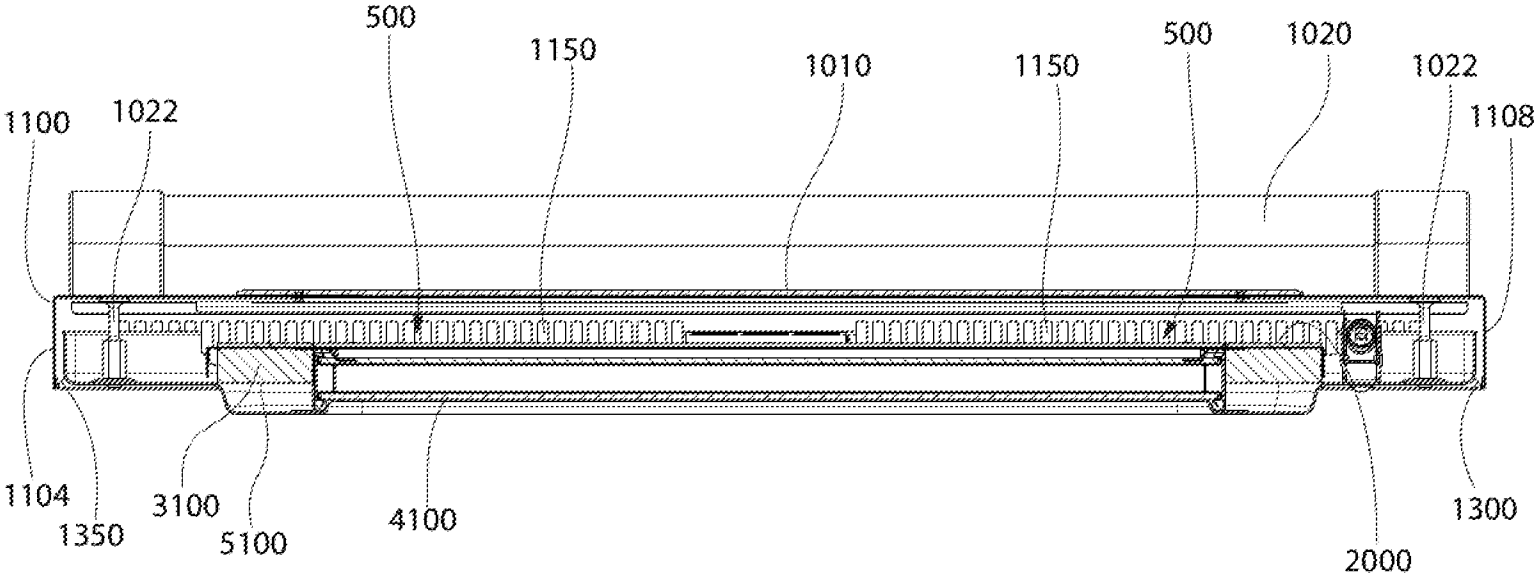
FIG. 20 is a sectional view of the appliance door shown in FIG. 2 taken along section line XX-XX of FIG. 7.

FIG. 7 is a front view of door 100 and shows the rectangular shape of main portion 1100 of outer skin 1000. A sectional view of door 100 taken along section lines XII-XII is shown in FIG. 12. A sectional view of door 100 taken along section lines XV-XV is shown in FIG. 15. A sectional view of door 100 taken along section lines XX-XX is shown in FIG. 20. FIG. 12 shows a section taken at a location where top upper air opening 1150 does not exist, whereas FIG. 15 shows a section taken at a location where top upper air opening 1150 does exist.

Figure 8:
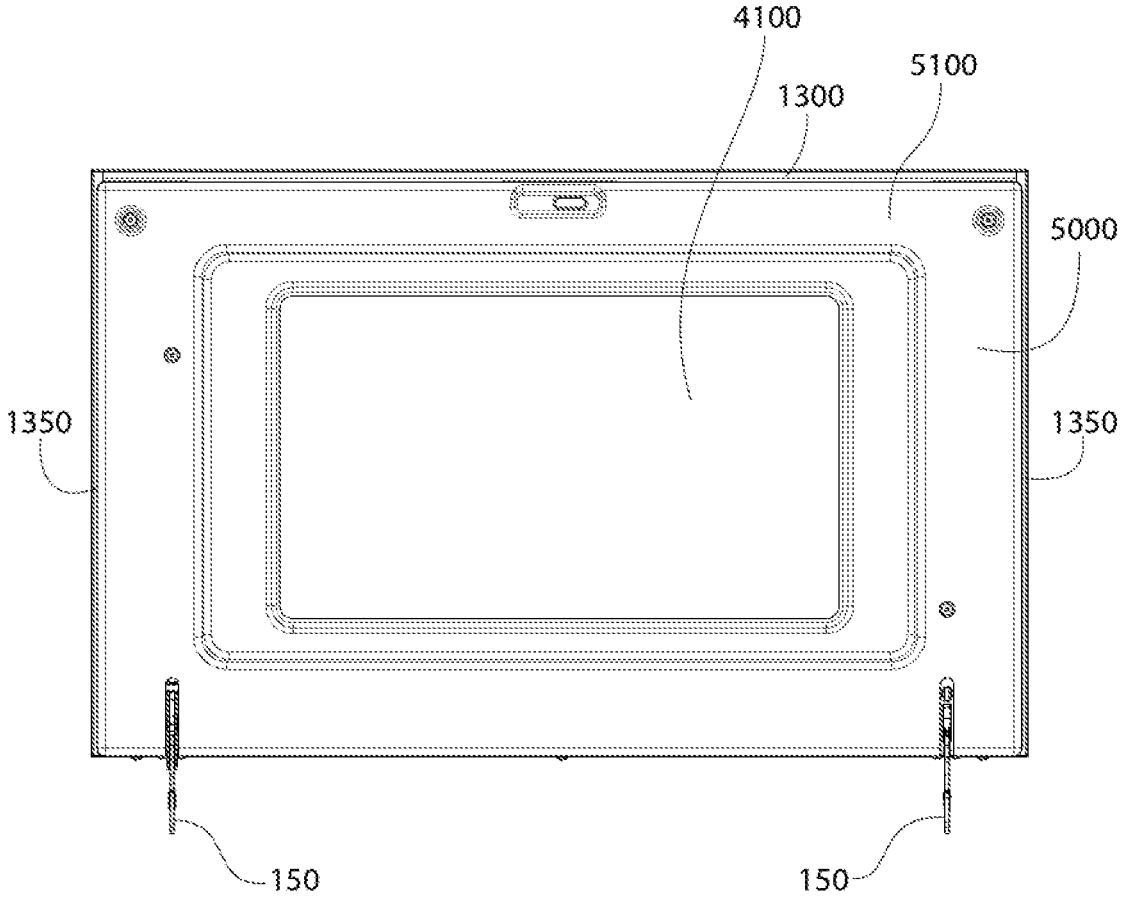
FIG. 8 is a rear view of the appliance door shown in FIG. 2.
Figure 9:
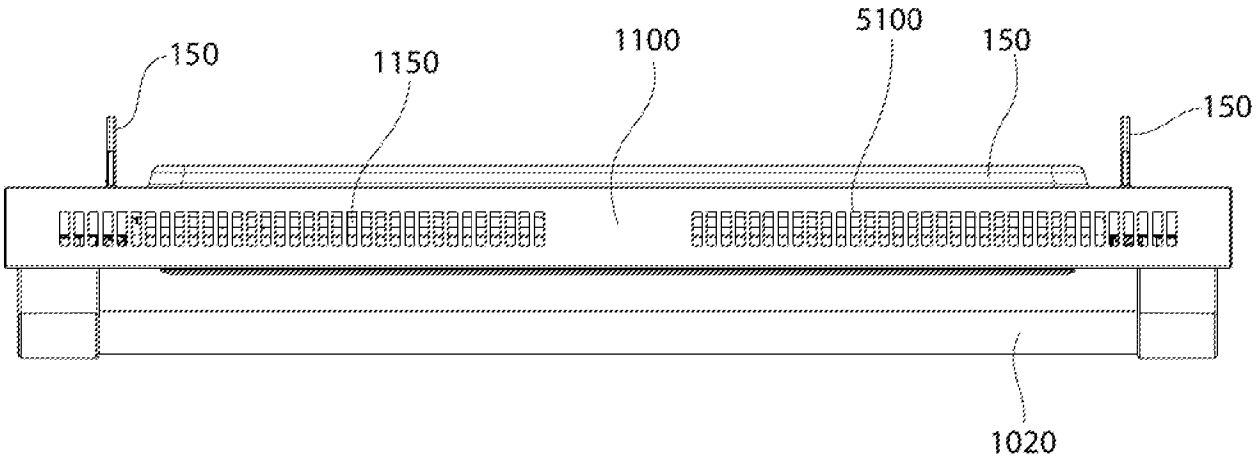
FIG. 9 is a top view of the appliance door shown in FIG. 2.
Figure 10:
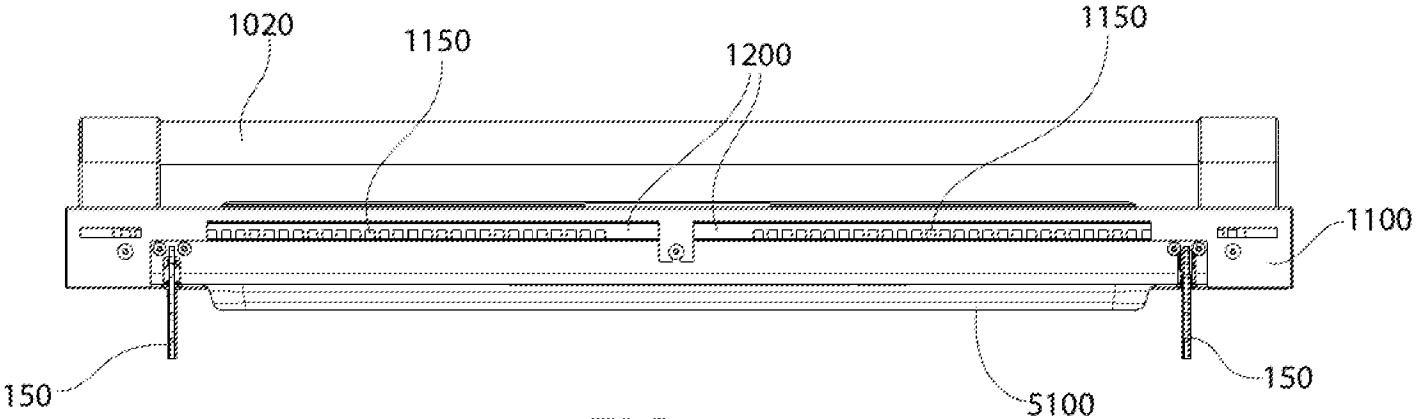
FIG. 10 is a bottom view of the appliance door shown in FIG. 2.

FIG. 8 is a rear view of door 100 and shows a side gap 1350 that, in this example, extends the entire height of door 100 between main portion 5100 of inner liner 5000 and main portion 1100 of outer skin 1000. Side gap 1350 is also shown in FIG. 20. FIG. 9 is a top view of door 100 that shows top upper air openings 1150 in main portion 1100 of outer skin 1000. In this embodiment, top upper air openings 1150 are a large number of slots. In other embodiments, top upper air opening 1150 is one opening or more or fewer openings than what is show in FIG. 9. FIG. 10 is a bottom view of door 100 and shows lower air openings 1200 formed between main portion 1100 of outer skin 1000 and main portion 5100 of inner liner 5000. An interior region of door 100 (shown in more detail below) is formed between inner liner 5000 and outer skin 1000. Portions of top upper air openings 1150 are visible in FIG. 10 through lower air openings 1200 because the interior region provides an unobstructed straight path from lower air openings 1200 to top upper air openings 1150.

Figure 11:
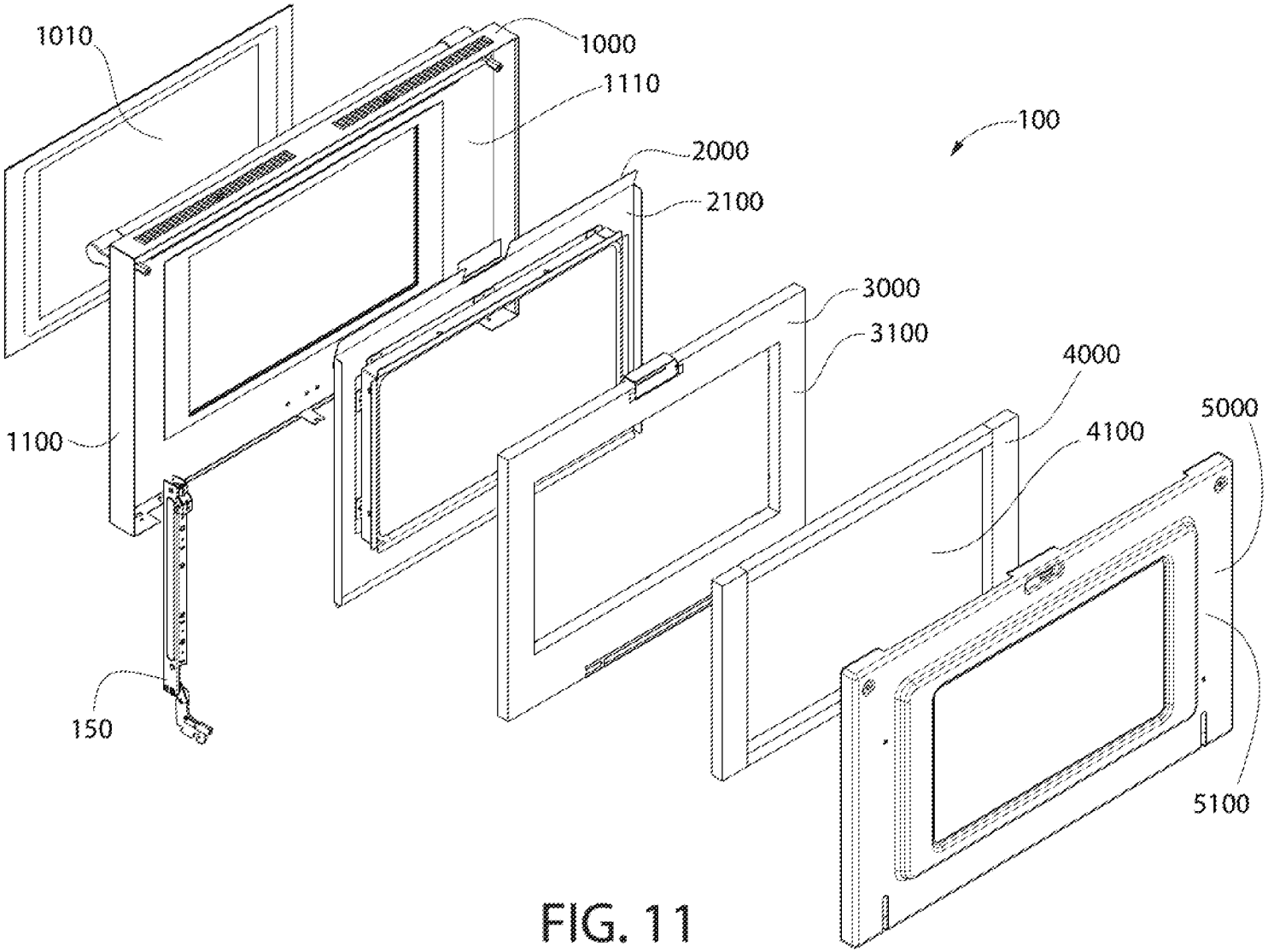
FIG. 11 is an exploded perspective view of the appliance door shown in FIG. 2.

FIG. 11 shows an example of door 100 in a disassembled state and shows the main components of door 100. In this example, a glass retainer 2000 has a main portion 2100 that holds glass pack 4000 and an insulating member 3000 to main portion 5100 of inner liner 5000. Insulating member has a main insulation portion 3100 that is, in this example, sandwiched between main portion 2100 of glass retainer 2000 and main portion 5100 of inner liner 5000 (see FIG. 16). Glass pack 4000 fits, in this example, inside a flange on glass retainer 2000. In this example, glass pack 4000 has two panes 4100 of glass or other transparent material that can withstand the temperatures that exist in the cooking compartment of appliance 10. In other examples, glass pack 4000 has fewer or more panes 4100. The various parts shown in FIG. 11 are only one example of parts that particular embodiments of the invention include. Other embodiments include fewer or more parts than shown in FIG. 11.

Figure 13:
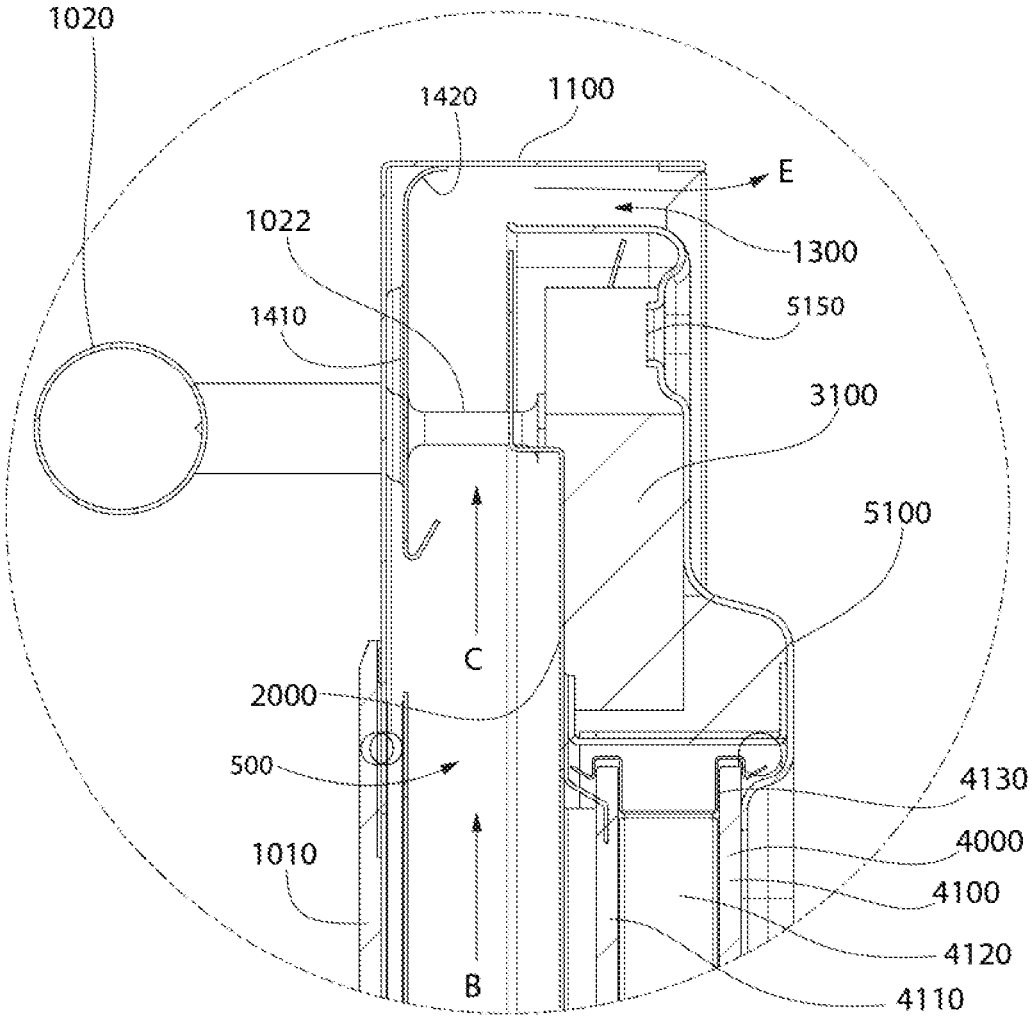
FIG. 13 is a magnified view of area XIII in FIG. 12.
Figure 14:
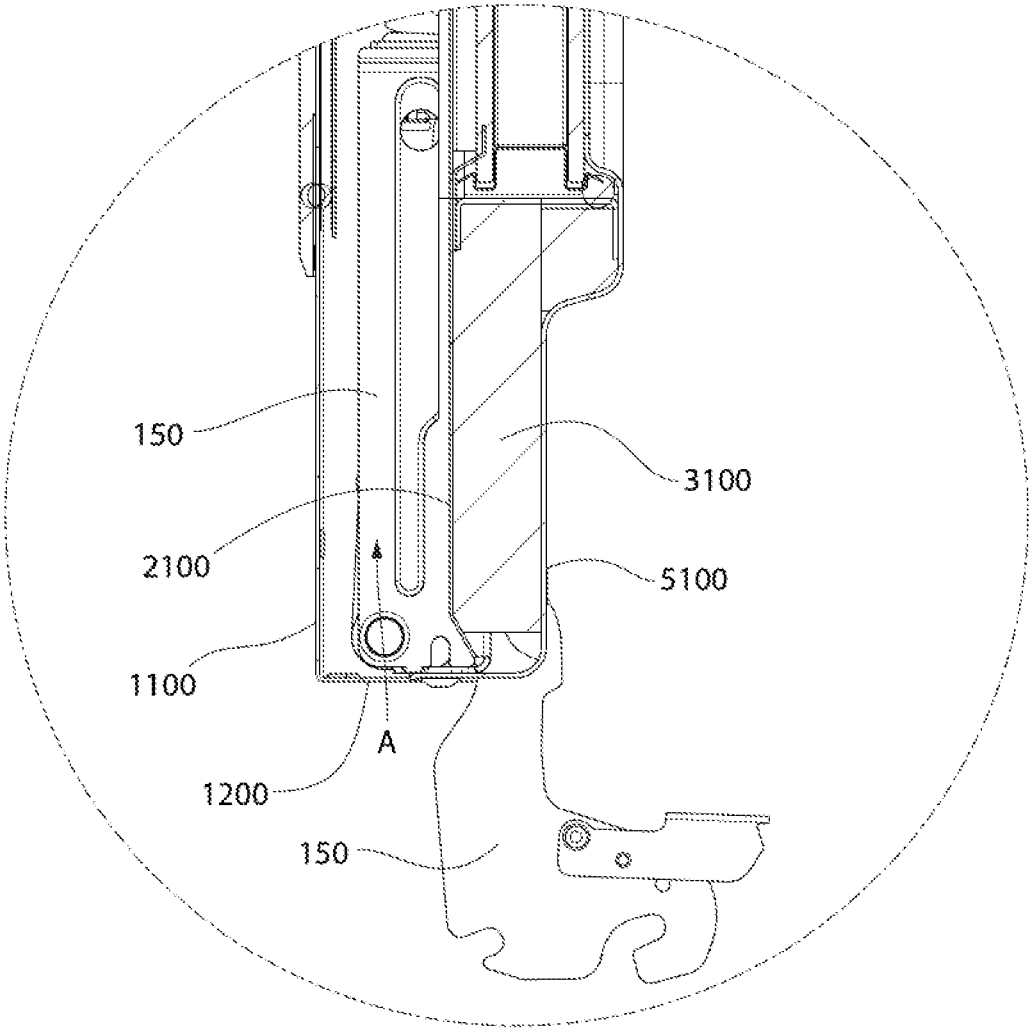
FIG. 14 is a magnified view of area XIV in FIG. 12.
Figure 17:
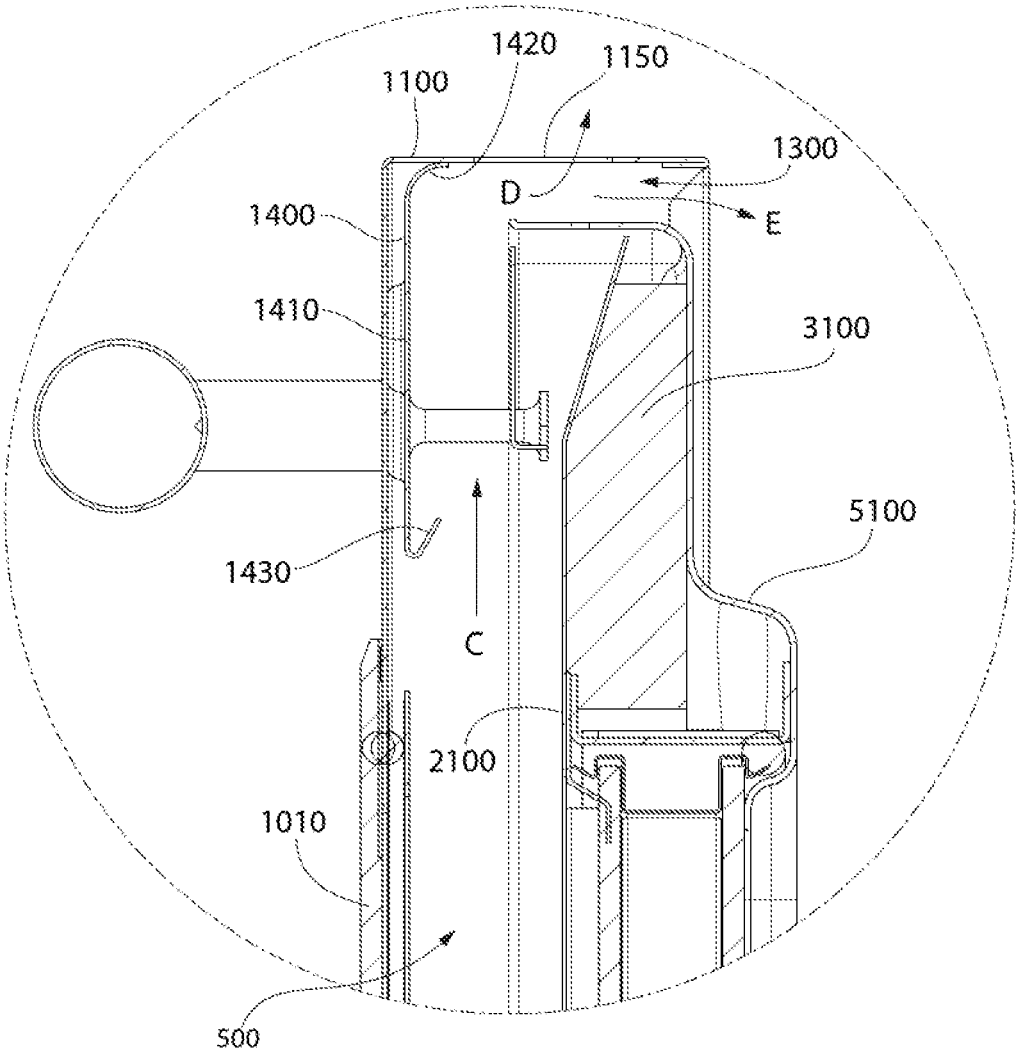
FIG. 17 is a magnified view of area XVII in FIG. 15.

FIG. 12 is a sectional view taken along section line XII-XII in FIG. 7, FIG. 13 is a magnified view of portion XIII of FIG. 12, and FIG. 14 is a magnified view of portion XIV of FIG. 12. As stated above, FIG. 12 shows a section taken at a location of door 100 where top upper opening 1150 does not exist. This is shown clearly in FIG. 13 by the absence of top upper opening 1150 in the uppermost surface of main portion 1100 of outer skin 1000. Referring back to FIG. 12, an air flow path is shown by arrows A, B, C, and E. Cooling air flows from an environment outside of door 100 into interior region 500 of door 100 through lower air opening 1200 as shown by Arrow A. The cooling air continues upward through interior region 500 and over glass retainer 2000 and pane 4110 of glass pack 4000 as shown by Arrow B. At the point of Arrow C, the cooling air passes from a larger cross-sectional area to a smaller cross-sectional area as the cooling air passes by an angled portion 1430 of an air guide 1400. In this example, air guide 1400 has a main body 1410, a curved portion 1420 and the angled portion 1430. In this example, the cooling air flow continues upward and then out of door 100 through two openings or sets of openings. As shown in FIG. 17, the cooling air flows out of top upper air openings 1150 where they exist (Arrow D), and as shown in both FIG. 13 and FIG. 17, the cooling air flows out of a rear upper air opening 1300. The relative sizes of the aggregate area of top upper air openings 1150 versus the aggregate area of rear upper air opening 1300 determines how much of the cooling air exits each opening/set of openings. The relative sizes/numbers of these openings can be set in order to provide the desired amount of air flow based on the configuration of appliance 10. For example, a configuration of appliance 10 that has a ventilation fan that is ducted to an area directly above top upper air openings 1150 provides a larger aggregate area of top upper air openings 1150 versus the aggregate area of rear upper air opening 1300 in order to promote more airflow through door 100.

In the example shown in FIGS. 12 and 13, rear upper air opening 1300 is formed as a gap between main portion 1100 of outer skin 1000 and main portion 5100 of inner liner 5000. This gap can be a continuous gap that adjoins side gap 1350 (shown in FIGS. 8 and 20), or can be separated from side gap 1350. In the embodiment shown in FIGS. 8 and 14, the gap between main portion 1100 of outer skin 1000 and main portion 5100 of inner liner 5000 does not extend along the lower portion of door 100. The absence of a gap along the lower portion of door 100 promotes the introduction of cooling air into door 100 from only the environment directly below door 100, which can be cooler air than the air that exists behind door 100.

FIGS. 12 and 13 show a spacer 1022 located in interior region 500. One or more spacers 1022 maintain a desired gap between main portion 1100 of outer skin 1000 and main portion 5100 of inner liner 5000, thus forming interior region 500. The location of spacer 1022 shown in the figures is just one example of a possible location of spacer 1022. In other embodiments (as shown in FIG. 20), spacer 1022 is aligned with a fastener opening 5150 in main portion 5100 of inner liner 5000, and a fastener extends from main portion 5100 of inner liner 5000, through fastener opening 5150, glass retainer 2000, spacer 1022, main portion 1100 of outer skin 1000, and into handle 1020.

FIG. 13 also shows an example of the construction of glass pack 4000. In this example, glass panes 4100 and 4110 are held relative to each other by a clip 4130 to create a central space 4120. Central space 4120 can be a sealed or an unsealed space. In the case of central space 4120 being a sealed space, central space 4120 can be substantially evacuated to produce a more effective thermal barrier between the cooking chamber and interior region 500. In embodiments, central space 4120 is filled with a gas that has better insulating properties than air.

Figure 18:
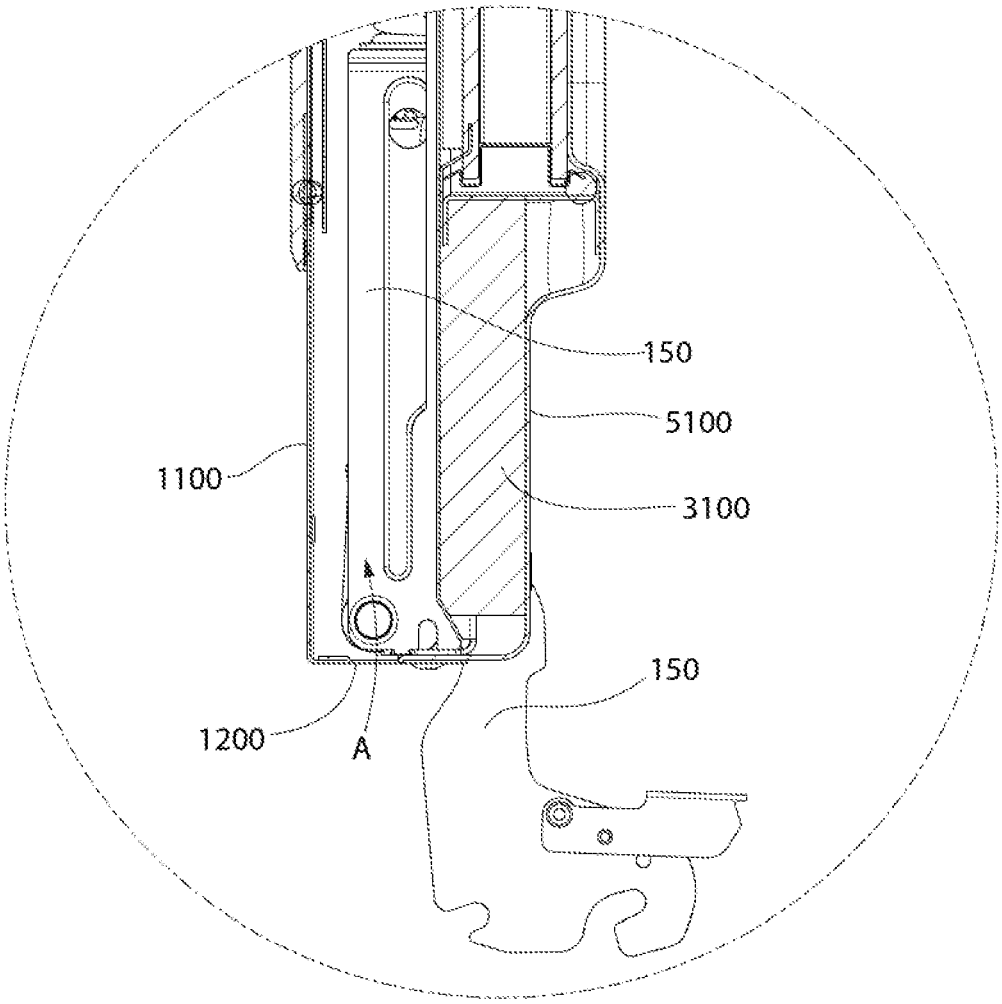
FIG. 18 is a magnified view of area XVIII in FIG. 15.

FIG. 15 is a sectional view taken along section line XV-XV in FIG. 7, FIG. 17 is a magnified view of portion XVII of FIG. 15, and FIG. 18 is a magnified view of portion XVIII of FIG. 15. As stated above, FIG. 15 shows a section taken at a location of door 100 where top upper opening 1150 exists. This is shown clearly in FIG. 17 by the presence of top upper opening 1150 in the uppermost surface of main portion 1100 of outer skin 1000. Otherwise, FIG. 15 is similar to FIG. 12.

Figure 16:
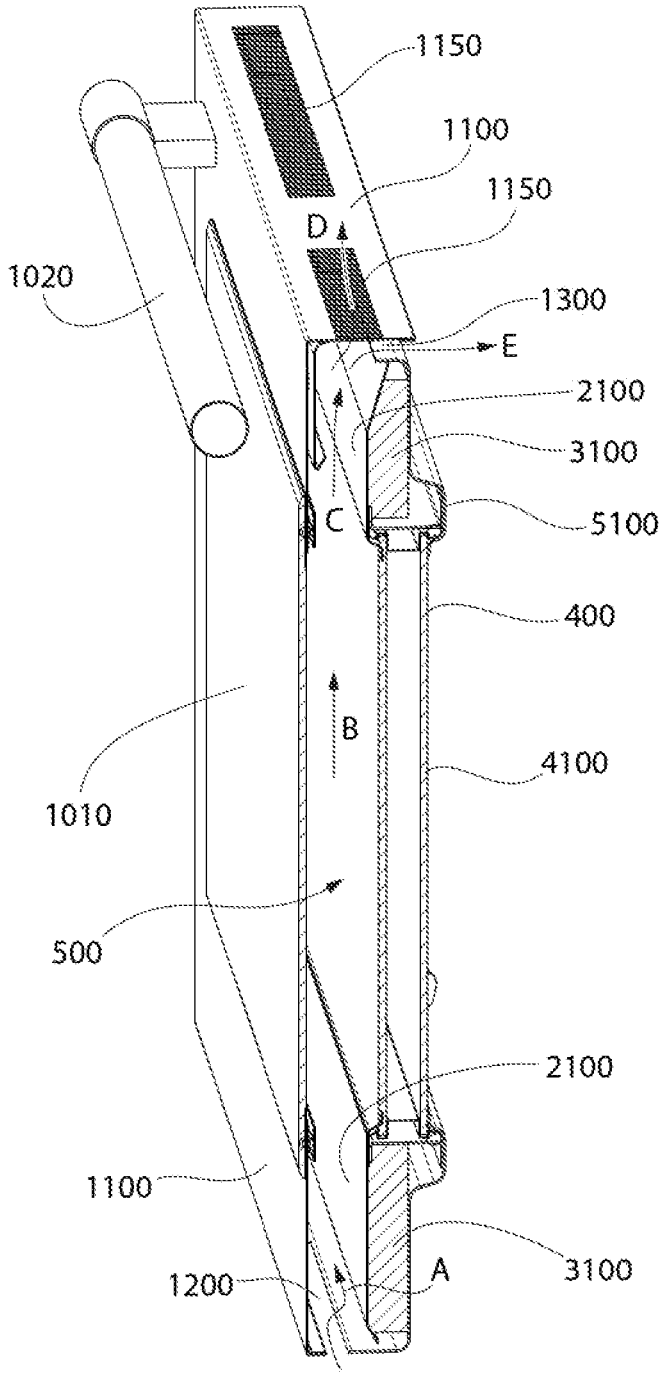
FIG. 16 is a sectional perspective view of the appliance door shown in FIG. 2.
Figure 19:
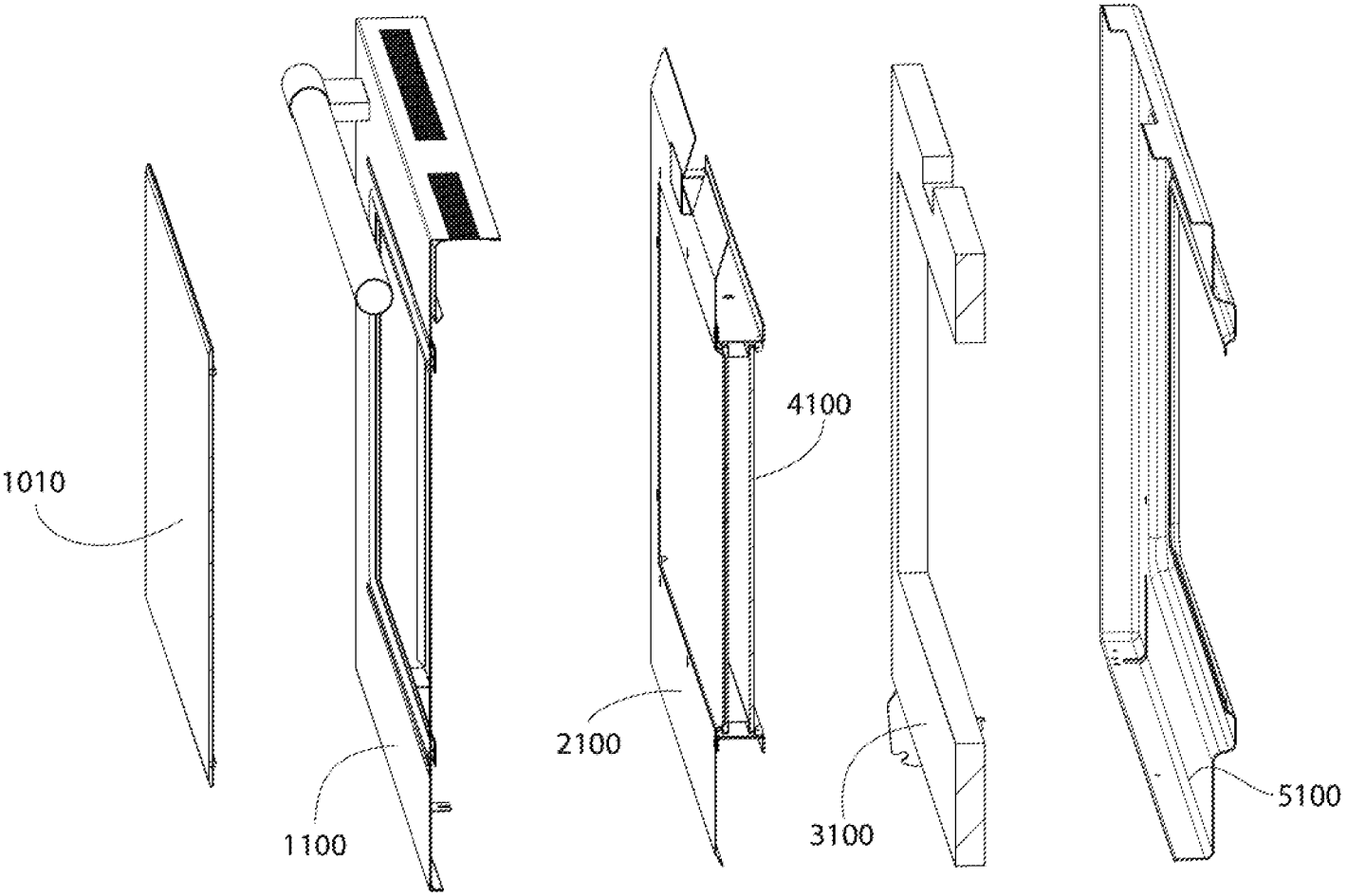
FIG. 19 is an exploded sectional perspective view of the appliance door shown in FIG. 2.

FIG. 16 is a perspective sectional view that shows the cooling air flow through door 100. FIG. 19 is an exploded view of the assembly shown in FIG. 16. The assembly shown in the figures is only one example of possible configurations of the invention.

FIG. 20 is a sectional view taken along section line XX-XX in FIG. 7 and looking upwards. As discussed above, FIG. 20 shows an example where spacer 1022 is aligned with fastener opening 5150 in main portion 5100 of inner liner 5000, and a fastener extends from main portion 5100 of inner liner 5000, through fastener opening 5150, glass retainer 2000, spacer 1022, main portion 1100 of outer skin 1000, and into handle 1020. FIG. 20 also shows an embodiment in which side sections 1104, 1108 and top section 1102 of main portion 1100 of outer skin 1000 extend rearward to cover all of main portion 5100 of inner liner 5000. This configuration provides an esthetically pleasing door while also ensuring that any cooling air that exits side gaps 1350 exits at the rearmost region of the sides of door 100.

In some embodiments, the various air openings and gaps are disposed adjacent to one or more ducts or air inlets in the main housing of the appliance such that vacuum from the duct or air inlet draws the cooling air out of the air openings and/or gaps (and thus out of inner region 500). The vacuum can be created by a fan, convection, or some other method. This movement of the cooling air away from the front of oven door 100 is beneficial in that it moves heat away from the user.

It will be appreciated that variants of the above-disclosed and other features and functions, or alternatives thereof, may be combined into many other different systems or applications. Any of the features described above can be combined with any other feature described above as long as the combined features are not mutually exclusive. Various presently unforeseen or unanticipated alternatives, modifications, variations or improvements therein may be subsequently made by those skilled in the art which are also intended to be encompassed by the invention.

What is claimed is:

1. A domestic cooking appliance for heating a food item, comprising:

a main housing;

a cooking compartment in the main housing, the cooking compartment being configured to receive the food item to be heated; and a door assembly attached to the main housing and movable between a closed position in which the door assembly closes the cooking compartment and an open position in which the door assembly allows access to the cooking compartment, the door assembly having an outer door skin, an inner door liner, a transparent viewing panel assembly between the outer door skin and the inner door liner, the viewing panel assembly permitting a user to view the cooking compartment when the door assembly is in the closed position, an interior region located between the outer door skin and the viewing panel assembly, a spacer positioned between, and maintaining a space between, the outer door skin and the inner door liner, the space comprising the interior region, wherein the spacer extends around a mounting fastener that attaches a handle of the door assembly to the inner door liner, a lower air opening in a lower region of the door assembly that fluidly connects the interior region with an environment outside of the door assembly, and a top upper air opening in an uppermost surface of the outer door skin that fluidly connects the interior region with the environment outside of the door assembly.

2. The domestic cooking appliance of claim 1, further comprising an air guide located in the interior region, the air guide having an angled portion, wherein the interior region has a first horizontal cross-sectional area taken at a location vertically between the angled portion of the air guide and the viewing panel assembly, the interior region has a second horizontal cross-sectional area at a location vertically between the angled portion of the air guide and the top upper air opening, and the second cross-sectional area is smaller than the first cross-sectional area.

3. The domestic cooking appliance of claim 2, wherein the viewing panel assembly comprises a planar viewing panel, the angled portion of the air guide is non-parallel to the viewing panel, and the angled portion of the air guide is non-perpendicular to the viewing panel.

4. The domestic cooking appliance of claim 1, wherein the outer door skin comprises a front face panel, an upper panel, a lower panel, a left side panel, and a right side panel, and the uppermost surface of the outer door skin is an upper surface of the upper panel of the outer door skin.

5. The domestic cooking appliance of claim 4, wherein the lower air opening is a gap between the outer door skin and the inner door liner.

6. The domestic cooking appliance of claim 5, wherein the lower air opening is in a lowermost surface of the door assembly.

7. The domestic cooking appliance of claim 1, further comprising a sealing surface of the main housing, the sealing surface at least substantially surrounding an opening in the main housing that provides access to the cooking compartment; and a sealing surface of the inner door liner that contacts the sealing surface of the main housing and provides a thermal seal between the main housing and the inner door liner, wherein the upper panel of the outer door skin extends horizontally to a vertical plane that is coplanar with the sealing surface of the inner door liner.

8. The domestic cooking appliance of claim 7, wherein a central portion of the inner door liner extends beyond the vertical plane and into the cooking compartment.

9. The domestic cooking appliance of claim 1, wherein the top upper air opening comprises a plurality of openings.

10. The domestic cooking appliance of claim 9, wherein the plurality of openings are slots.

11. The domestic cooking appliance of claim 1, wherein an unobstructed straight vertical path exists between the lower air opening and the top upper air opening, the unobstructed straight vertical path extending through the interior region.

12. The domestic cooking appliance of claim 1, further comprising a rear upper air opening that is formed by a vertically extending gap between an upper surface of the inner door liner and a lower surface of the upper panel of the outer door skin.

13. The domestic cooking appliance of claim 1, further comprising a side gap between the outer door skin and the inner door liner at a side location of the door assembly, the side location being positioned between the top upper air opening and the lower air opening, the side gap fluidly connecting the interior region with the environment outside of the door assembly.

14. A door assembly for a domestic cooking appliance having a cooking compartment for heating a food item, the door assembly comprising:

an outer door skin;

an inner door liner;

a transparent viewing panel assembly between the outer door skin and the inner door liner, the viewing panel assembly being configured to permit a user to view the cooking compartment when the door assembly is in a closed position;

an interior region located between the outer door skin and the viewing panel assembly;

a spacer positioned between, and maintaining a space between, the outer door skin and the inner door liner, the space comprising the interior region, wherein the spacer extends around a mounting fastener that attaches a handle of the door assembly to the inner door liner;

a lower air opening in a lower region of the door assembly that fluidly connects the interior region with an environment outside of the door assembly; and a top upper air opening in an uppermost surface of the outer door skin that fluidly connects the interior region with the environment outside of the door assembly.

15. The door assembly of claim 14, further comprising an air guide located in the interior region, the air guide having an angled portion, wherein the interior region has a first horizontal cross-sectional area taken at a location vertically between the angled portion of the air guide and the viewing panel assembly, the interior region has a second horizontal cross-sectional area at a location vertically between the angled portion of the air guide and the top upper air opening, and the second cross-sectional area is smaller than the first cross-sectional area.

16. The door assembly of claim 15, wherein the viewing panel assembly comprises a planar viewing panel, the angled portion of the air guide is non-parallel to the viewing panel, and the angled portion of the air guide is non-perpendicular to the viewing panel.

17. The door assembly of claim 14, wherein an unobstructed straight vertical path exists between the lower air opening and the top upper air opening, the unobstructed straight vertical path extending through the interior region.

18. The door assembly of claim 14, further comprising a rear upper air opening that is formed by a vertically extending gap between an upper surface of the inner door liner and a lower surface of the upper panel of the outer door skin.

* * * * *